US010197266B2

(12) United States Patent
Gauthier

(10) Patent No.: US 10,197,266 B2
(45) Date of Patent: Feb. 5, 2019

(54) BOILER SYSTEM COMPRISING AN INTEGRATED ECONOMIZER

(71) Applicant: THERMODESIGN INC., Boucherville (CA)

(72) Inventor: Réjean Gauthier, Mont Saint-Hilaire (CA)

(73) Assignee: Thermodesign, Inc., Boucherville (CA)

( * ) Notice: Subject to any disclaimer, the term of this patent is extended or adjusted under 35 U.S.C. 154(b) by 384 days.

(21) Appl. No.: 14/737,785

(22) Filed: Jun. 12, 2015

(65) Prior Publication Data

US 2015/0362176 A1 Dec. 17, 2015

Related U.S. Application Data

(60) Provisional application No. 62/011,238, filed on Jun. 12, 2014.

(51) Int. Cl.

| | |
|---|---|
| ***F22D 1/02*** | (2006.01) |
| *F22D 1/06* | (2006.01) |
| *F22B 21/04* | (2006.01) |
| *F22B 21/34* | (2006.01) |
| *F22D 1/10* | (2006.01) |
| *F22D 1/20* | (2006.01) |

(52) U.S. Cl.

CPC ..... *F22D 1/02* (2013.01); *F22B 21/04* (2013.01); *F22B 21/346* (2013.01); *F22D 1/06* (2013.01); *F22D 1/10* (2013.01); *F22D 1/20* (2013.01)

(58) Field of Classification Search

CPC ..... F22D 1/02; F22D 1/06; F22D 1/10; F22D 1/20; F22B 21/04; F22B 21/346

USPC ..... 122/1 C, 68, 81, 82, 195, 403, 421

See application file for complete search history.

(56) References Cited

U.S. PATENT DOCUMENTS 1,677,901 A * 7/1928 Nelis ..... F22B 17/02 122/421

2,065,559 A 12/1936 Blodgett (Continued)

FOREIGN PATENT DOCUMENTS

| | | | |
|---|---|---|---|
| CA | 2205452 | * | 11/1998 |
| CA | 2205452 | A1 | 11/1998 |
| GB | 1473072 | A | 5/1977 |

*Primary Examiner* — Steven B McAllister
*Assistant Examiner* — Benjamin W Johnson
(74) *Attorney, Agent, or Firm* — Forge IP, PLLC

(57) ABSTRACT

A boiler system and methods for heating a fluid are disclosed, in particular for heating water for producing steam. The boiler comprises an economizer module integrated on the top of a furnace, and is in communication with the furnace to receive heat and/or hot combustion gases therefrom. The economizer comprises tubes receiving the fluid, such as feedwater, to be pre-heated and providing it to the furnace comprising a combustion chamber producing heat and hot combustion gases. The fluid is pre-heated by circulating first through the pre-heating tube assembly of the economizer module before entering the furnace module where the fluid is further heated by the combustion chamber. Since the economizer is located on the furnace module, the boiler does not have a large footprint compared to a regular boiler system without an economizer. Due to the total integration of the economizer with the furnace, the boiler system has improved energy efficiency.

15 Claims, 4 Drawing Sheets

(56) References Cited

U.S. PATENT DOCUMENTS

| | | | | |
|---|---|---|---|---|
| 2,117,511 | A * | 5/1938 | Scott | F24H 1/44 122/333 |
| 2,312,223 | A * | 2/1943 | Titlestad | C01B 17/806 122/7 R |
| 2,415,123 | A * | 2/1947 | Zoller | F22D 1/02 122/477 |
| 3,081,749 | A | 3/1963 | Stabenow | |
| 3,280,800 | A | 10/1966 | Sullivan | |
| 3,368,536 | A | 2/1968 | Sullivan | |
| 4,170,964 | A | 10/1979 | Jehn et al. | |
| 4,342,286 | A | 8/1982 | Pollock | |
| 7,958,933 | B2 | 6/2011 | Castello | |
| 2010/0326373 | A1* | 12/2010 | Lapierre | F22B 21/346 122/259 |

* cited by examiner

BOILER SYSTEM COMPRISING AN INTEGRATED ECONOMIZER

CROSS-REFERENCE TO RELATED APPLICATIONS

The present patent application claims the benefits of priority of U.S. Patent Application No. 62/011,238, entitled "Boiler System Comprising an Integrated Economizer", and filed at the U.S. Patent Office on Jun. 12, 2014, the content of which is incorporated herein by reference.

FIELD OF THE INVENTION

The present invention generally relates to boiler systems, more particularly but not limited to flexible tube boiler systems, for heating a fluid, in particular but not limited to the heating of water to produce steam.

BACKGROUND OF THE INVENTION

The use of boilers and boiler systems is well known in the art and many different designs have been proposed such as for instance in U.S. Pat. No. 2,065,559 (Blodgett), U.S. Pat. No. 3,280,800 (Sullivan); U.S. Pat. No. 3,368,536 (Sullivan); U.S. Pat. No. 4,170,964 (Jehn et al.); or U.S. Pat. No. 4,342,286 (Pollock).

Boilers are generally used for heating fluids such as water, glycol/water mixtures, thermal fluids, etc. or for producing steam at low or high pressure. When referring to hot water or hot fluid, reference is generally made to water or fluid having a desired temperature exceeding 250 Fahrenheit (about 120 degrees Celsius). Higher temperatures can be reached in function of the fluid. Furthermore, reference is generally made to fluid since most hot fluid generators may be used for heating water but also as aforesaid for heating thermal oils and other fluids. When feedwater is injected into the boiler, the produced steam can be used to power turbines or other steam-powered engines.

Though many boiler designs are known in the art, it remains that the vast majority of these boilers requires significant amount of energy for generating the required heated fluid or steam. As such, there is a constant need to improve the energy efficiency of boilers. However, the need for more energy efficient boilers is tempered by their costs.

One often used solution to increase the energy efficiency of boilers is to add an economizer. As is known in the art, economizers are typically a heat exchanging device that heat fluids, usually but not necessarily water, up to but normally not beyond the boiling point of that fluid. An economizer is so named because it can make use of the enthalpy in fluid streams that are hot, but not hot enough to be used in a boiler, thereby recovering more useful energy and improving the boiler's efficiency.

A common application of economizers in boilers is to capture the wasted heat from boiler stack gases (flue gases) and transfer it to the boiler feedwater. This raises the temperature of the boiler feedwater, thus lowering the needed energy input, in turn reducing the firing rates to accomplish the rated boiler output.

However, economizers are generally standalone equipment, sold separately, which require labor and parts in order to be fitted to existing boiler systems. The overall additional equipment is often bulky and requires a substantial amount of space. In addition, most of the time, the additional equipment needs to be transported to the boiler site, which also raises the costs. Moreover, the equipment is also often required by industries located in geographical regions wherein specialized or skilled labor is not readily available.

In view of the foregoing, there is a need of a different approach in the use of economizers in boilers that will mitigate at least some of the shortcomings of the current approaches.

SUMMARY OF THE INVENTION

A boiler system in accordance with the principles of the present invention generally mitigates at least some of the shortcomings of prior art combination of boiler systems and economizers by comprising a fully integrated economizer.

Hence, the invention is first directed to a boiler system for heating a fluid, such as heating feedwater for producing steam. The boiler system comprises an economizer module integrated on a top portion of a furnace module, the economizer module being in communication with the furnace module to receive heat and/or hot combustion gases from the furnace module, the economizer module comprising a pre-heating tube assembly adapted for receiving the fluid to be pre-heated and for providing the fluid to the furnace module; the furnace module comprising a combustion chamber adapted for producing heat and hot combustion gases for heating the fluid circulating through the furnace module;

whereby, in use, the fluid is pre-heated by circulating first through the pre-heating tube assembly of the economizer module before entering the furnace module where the fluid is further heated by the combustion chamber.

The invention is also directed to a method for producing high temperature fluid with the boiler system as defined herein, such as for heating feedwater to produce high-temperature steam. The method comprising the steps of:

a) pre-heating a fluid by circulating the fluid through the pre-heating tube assembly of the economizer module; and b) further heating the fluid pre-heated in step a) by circulating the fluid through the furnace module.

The invention is also directed to a method for producing high temperature fluid, such as high-temperature steam by heating feedwater, with a boiler system comprising an economizer module and a furnace module, the method comprising the steps of:

a) pre-heating a fluid by circulating the fluid through a pre-heating tube assembly of the economizer module, the economizer module being integrated on a top portion of the furnace module, the economizer module being in communication with the furnace module to receive heat and/or hot combustion gases produced by the furnace module; and b) further heating the fluid pre-heated in step a) by circulating the fluid through the furnace module having a combustion chamber producing said heat and hot combustion gases.

The integrated economizer is located on the top of the boiler such as to be supported by the furnace module. In such embodiments, no economizer headers and no valving equipment are required for the economizer module to become part of the boiler system. The economizer module is generally fed with a fluid, preferably typically supplied from a deaerator. As such, the temperature of that fluid is generally lower than the saturation temperature in the boiler, thus allowing the transfer of extra heat from the flue gases to the boiler fluid wherein the fluid is forced through the economizer by boiler fluid pumps.

Understandably, a boiler system with an integrated economizer in accordance with the principles of the present invention generally mitigates at least some shortcomings of prior art boiler systems. For instance, since the economizer is located at the top of the boiler, the combined boiler and economizer does not have a larger footprint compared to a regular boiler system without economizer. Furthermore, since the boiler system is installed with its integrated economizer, there are important transportation and installation costs savings. In addition, due to the total integration of the economizer with the boiler system, the boiler system generally has improved energy efficiency.

The present invention is particularly adapted for heating water and producing high-temperature steam. Feedwater enters first the economizer module before entering the furnace module. In addition, due to the complete integration of the economizer on the top of the boiler system, the boiler system can provide significant transportation and installation costs savings as boiler system and its economizer are transported and installed only once.

Other and further aspects and advantages of the present invention will be obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

The above and other aspects, features and advantages of the invention will become more readily apparent from the following description, reference being made to the accompanying drawings in which.

DETAILED DESCRIPTION OF SOME PREFERRED EMBODIMENTS

Boiler System

A novel boiler system comprising an integrated economizer will be described hereinafter. Although the invention is described in terms of specific illustrative embodiments, it is to be understood that the embodiments described herein are by way of example only and that the scope of the invention is not intended to be limited thereby.

Figure 1:
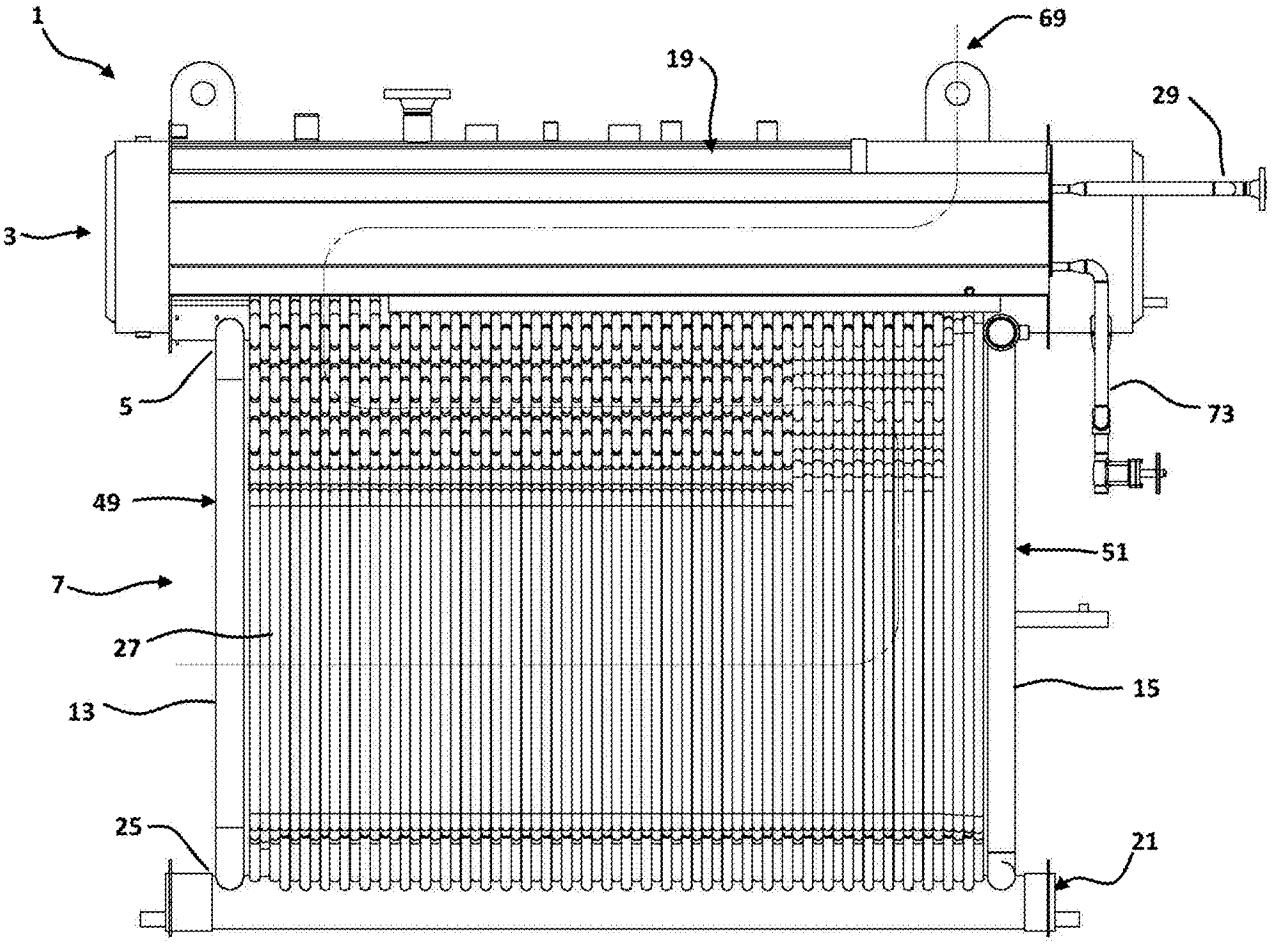
FIG. 1 is a side view of an embodiment of a boiler system with an economizer integrated to the top of the boiler in accordance with the principles of the present invention.

Reference will be made herein after to FIGS. 1 to 4, in which:

1 Boiler system
3 Economizer module
5 Top portion of the Furnace module
7 Furnace module
9 Pre-heating tube assembly
11 Combustion chamber
13 Front wall
15 Rear wall
19 Upper header or drum
21 Lower header
25 Bottom portion of the boiler system
27 Tubes of the furnace module
29 Inlet of the economizer module
31, 33 Tube sub-assemblies
35 Tubes of the sub-assemblies
37 Baffles
41, 43, 45, 47 Conduits of the furnace module
49, 51 Downcomers
53 First section of the furnace tubes
55 Horizontal floor section of the tubes
57 Riser section of the tubes
59 Interconnected U-shaped sections
61 Central vertical plane
63 Entry section
65 Casing of the economizer
67 Door of the casing
69 Combustion gas outlet
71 Insulating material
73 Feedwater outlet
77 Casing of the furnace module
79 Fins A boiler system 1 according to the present invention, such as the one illustrated on FIG. 1, is used for heating a fluid. Boilers are generally used for heating fluids such as water, glycol/water mixtures, thermal fluids, etc. or for producing steam at low or high pressure. Furthermore, reference is generally made to fluid since most hot fluid generators may be used for heating water but also as aforesaid for heating thermal oils and other fluids. When referring to hot water or hot fluid, reference is generally made to water or fluid having a desired temperature exceeding 250 Fahrenheit (about 120 degrees Celsius). Preferably, in the boiler system according to the present invention, feedwater is heated to produce high-temperature steam.

The boiler system 1 comprises an economizer module 3 integrated on a top portion 5 of a furnace module 7. The economizer module 3 is in communication with the furnace module 7 to receive heat and/or hot combustion gases from the furnace module 7. The economizer module 3 comprises a pre-heating tube assembly 9 adapted for receiving the fluid to be pre-heated and for providing the fluid to the furnace module; the furnace module 7 comprises a combustion chamber 11 (see FIG. 3) adapted for producing heat and hot combustion gases for heating the fluid circulating through the furnace module 7. The fluid, such as feedwater, is pre-heated by circulating first through the pre-heating tube assembly 9 of the economizer module 3 before entering the furnace module 7 where the fluid is further heated by the combustion chamber 11.

Figure 2:
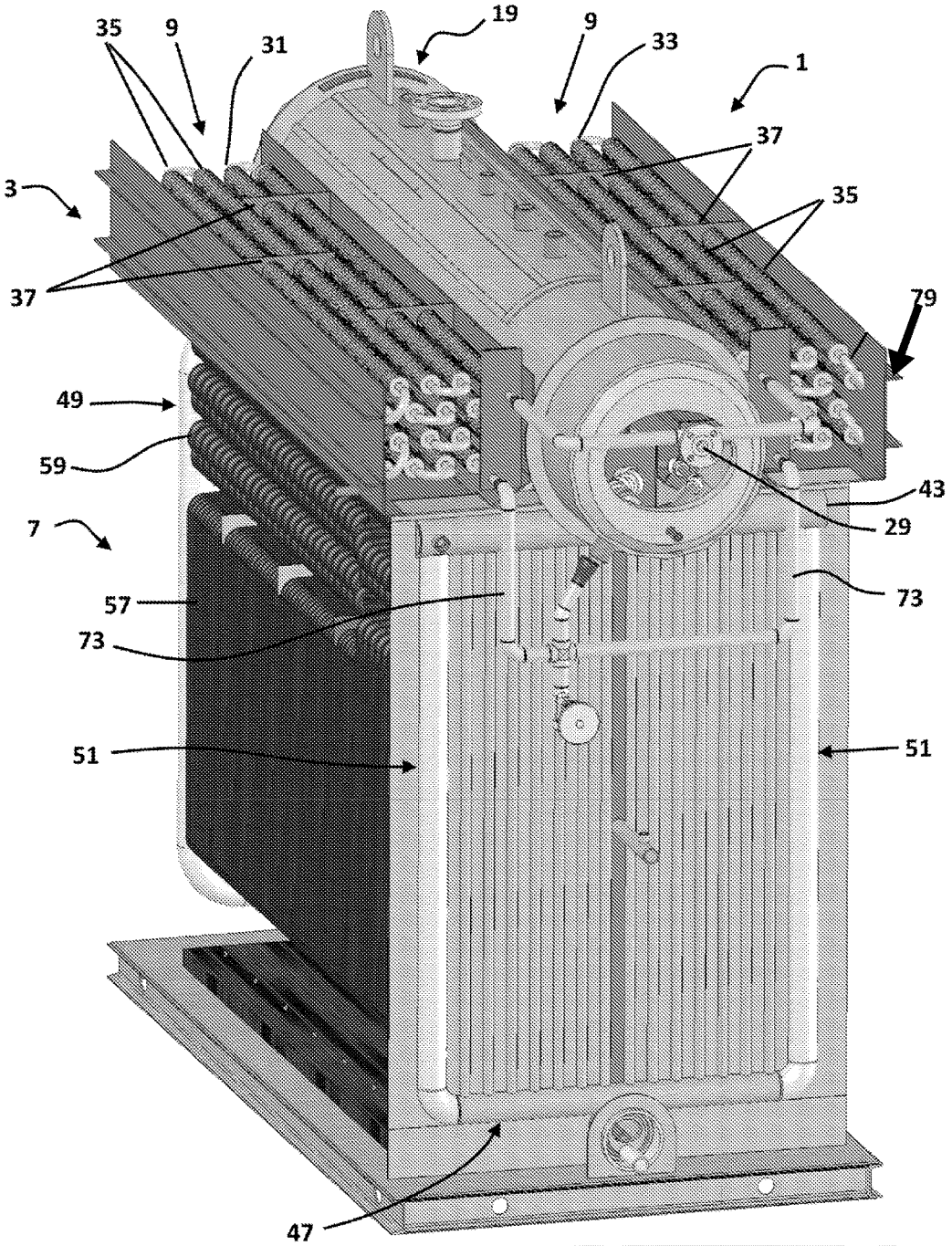
FIG. 2 is a perspective rear view of the uncovered boiler system of FIG. 1 having a two modules economizer integrated on each side of the boiler steam drum or upper header.
Figure 3:
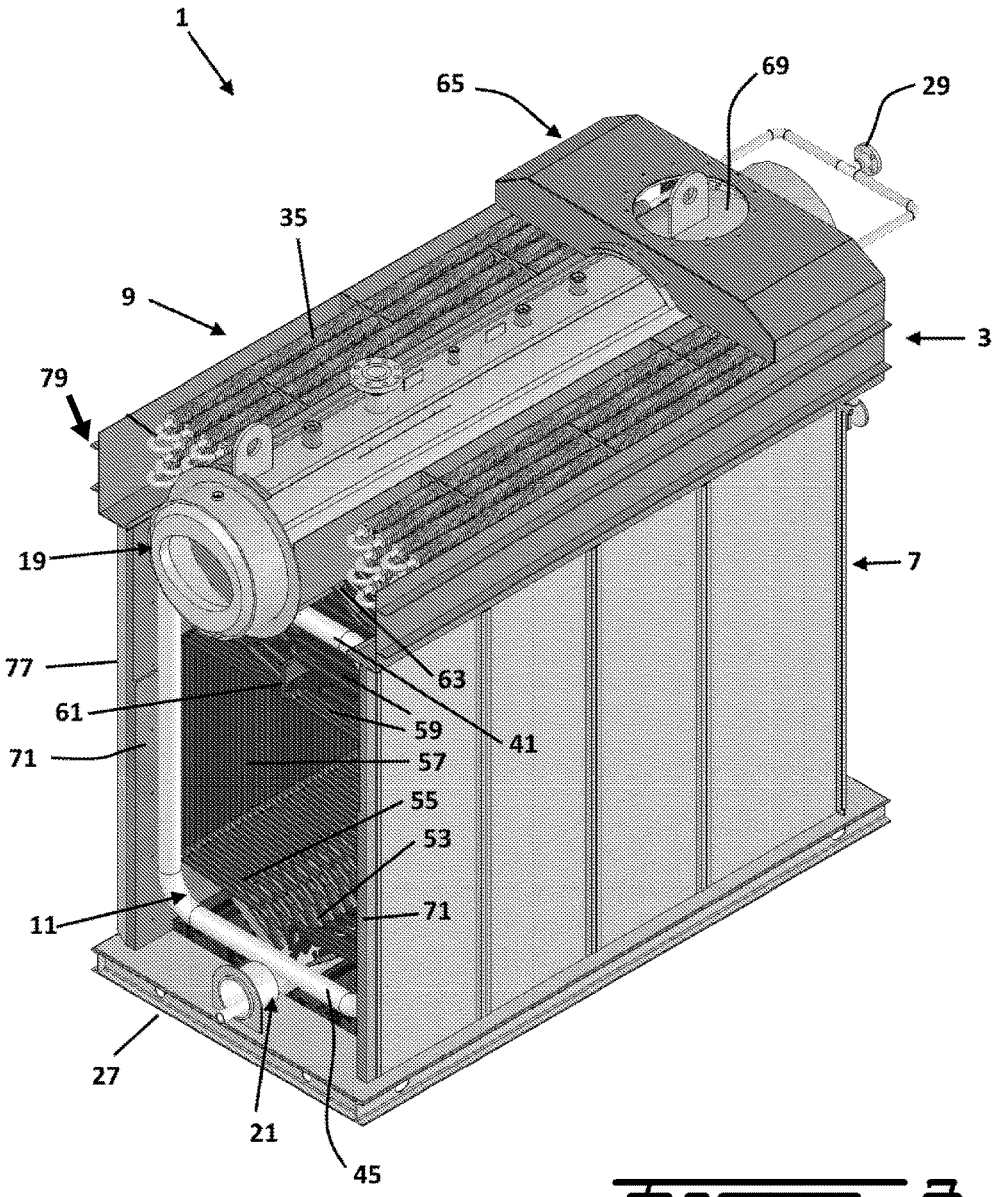
FIG. 3 is a perspective front view of the boiler system of FIG. 1, partially covered, with side inner casing.
Figure 4:
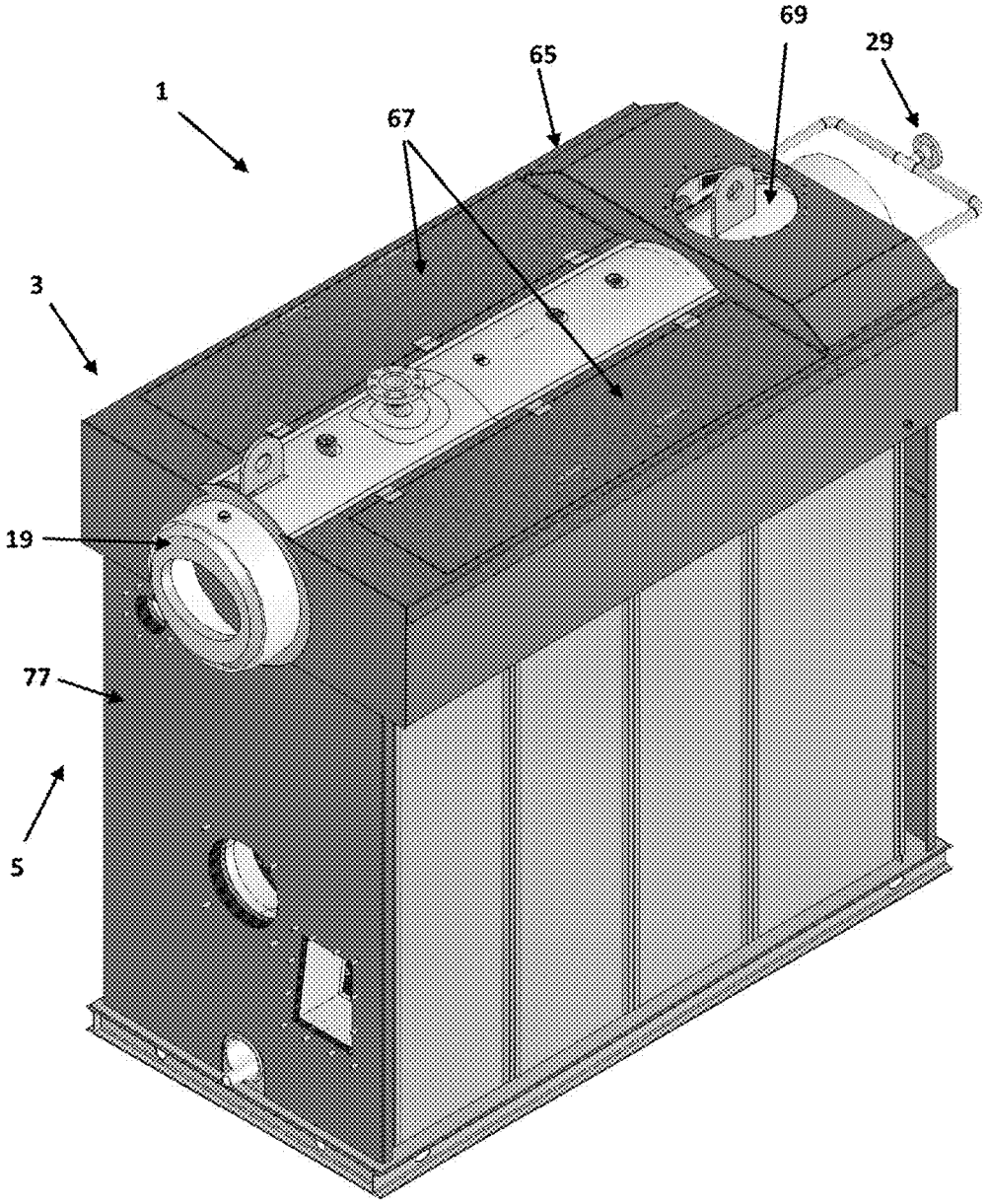
FIG. 4 is a perspective front view of the boiler system of FIG. 1, fully covered, with side inner casing and top access panels.

Referring to FIGS. 2 to 4, according to one embodiment of the present invention, the boiler system 1 further comprises:

a front wall 13, a rear wall 15 and a pair of opposed side walls extending between the front and rear walls 13, 15;

an upper header 19 extending between the front and rear walls 13, 15 along a mid-section of the top portion 5 of the boiler system 1;

a lower header 21 extending between the front 13 and rear 15 walls along a mid-section of a bottom portion 25 of the boiler system 1, and a plurality of furnace module tubes 27 extending between the lower 21 and upper 19 headers while being in fluid communication therewith.

According to one embodiment, the pre-heating tube assembly 9 of the economizer module 3 may comprise an inlet 29 for providing the fluid to be heated to two tube sub-assemblies 31, 33 located respectively on each side of the upper header 19 of the boiler system 1, each sub-assembly comprising a series of economizer tubes 35 fluidly connected to the inlet 29 in which the fluid is pre-heated using the combustion gases from the furnace module. Preferably, each sub-assembly 31, 33 may comprise one or more circuits of the economizer tubes 35 in a parallel pattern longitudinal with the upper header. Also, as illustrated on FIG. 2, the tubes 35 of each sub-assembly 31, 33 may be arranged in a staggered pattern for optimizing heat transfer from the combustion gases to the fluid circulating in the economizer tubes of the sub-assemblies 31, 33.

According to one embodiment, each sub-assembly 31, 33 of the economizer module 3 may further comprise a plurality of baffles 37 alternatively extending from the upper header 19 and from each respective side wall 17 in order to force the combustion gases to flow in zigzag in a cross flow pattern from the front wall 13 to the rear wall 15 in order to enhance heat transfer from the combustion gases to the fluid.

According to one embodiment, the boiler system 1 may further comprise:

a first upper horizontal conduit 41 located proximate the front wall 13, a second upper horizontal conduit 43 located proximate the rear wall 15 and being in fluid communication with the upper header 19, a first lower horizontal conduit 45 located proximate the front wall 13, a second lower horizontal conduit 47 located proximate the rear wall 15 and being in fluid communication with the lower header 21, a first pair of downcomers 49 located adjacent the front wall 13 and being in fluid communication with the first upper horizontal conduit 41 and the first lower horizontal conduit 45, and a second pair of downcomers 51 located adjacent the rear wall 15 and being in fluid communication with the second upper horizontal conduit 43 and the second lower horizontal conduit 47; wherein the conduits 41, 43, 45, 47 and downcomers 49, 51 define a frame for the boiler system 1.

According to one embodiment, the economizer module 3 located on the top portion 5 of the boiler system 1 is supported by the frame comprising conduits 41, 43, 45, 47 and downcomers 49, 51, wherein such conduits 41, 43, 45, 47 and such downcomers 49, 51 are used to add extra heating surfaces to recover heat from hot combustion gases.

In such embodiments, the downcomers 49, 51 may be used to add extra heating surfaces to recover heat from the exhaust gases. Still, the economizer module 3 generally comprises two sub-assemblies 31, 33 respectively located on each side of the upper header 19 of the boiler system 1. Each of the sub-assemblies 31, 33 comprises a series of economizer tubes 35 in which fluid to be pre-heated using the flue gases can circulate. In such embodiment, no economizer headers and no valving equipment are required for the economizer tubes 35 to become part of the boiler 1. The economizer tubes 35 are generally fed with fluid typically supplied from a deaerator. As such, the temperature of that fluid is generally lower than the saturation temperature in the boiler, thus allowing the transfer of extra heat from the flue gases to the boiler fluid wherein the fluid is forced through the economizer by the boiler fluid pumps.

According to one embodiment illustrated on FIG. 3, each economizer tube 35 extending between and being in fluid communication with the upper header 19 and the lower header 21 may have a profile comprising a first section 53 exiting from the lower header 21, a horizontal floor section 55, a riser section 57 extending vertically upwardly adjacent one of the sidewalls, a plurality of interconnected U-shaped sections 59 between one of the sidewalls and a central vertical plane 61 of the boiler system 1, and an entry section 63 extending between an uppermost of the U-shaped sections 59 and the upper header 19.

According to one embodiment, the furnace module tubes 27 are designed to have three different profiles:

in a first section of the boiler system 1 proximate the front wall 13 thereof, the furnace module tubes 27 have a first and a second profiles alternating in a tangential manner; and in a rearward section of the boiler system 1 proximate the rear wall 15 thereof, the furnace module tubes 27 have a first and a third profiles arranged in a non-tangential manner;

these arrangements of furnace module tubes 27 forcing the combustion gases passing through the front section of the boiler system 1 to flow in a longitudinal direction while in the rear section, the combustion gases are permitted to flow upwardly through a turning lane into a convection section of the boiler system 1.

According to one embodiment, the boiler system 1 may further comprise a casing 65 encasing the economizer module 3, the casing 65 comprising at least one cleaning door 67 providing access inside the economizer module 3 to allow for cleaning and/or maintenance thereof. Preferably, the casing 65 may further comprise a combustion gas outlet 69 for letting the combustion gas to exit the boiler system 1. More preferably, the economizer casing 65 can be configured as a gas-tight chamber, the casing being insulated with an insulating material 71 (see FIG. 3).

Example of use of the Boiler System with Feedwater

Referring first to FIG. 1, in a boiler system 1 in accordance with the principles of the present invention, water enters the economizer module 3 located at the top portion 5 of boiler 1 through feedwater inlet 29. The water generally circulates through the economizer tubes 35, which may be bare or finned. The economizer tubes 35 are heated by the flue gases which generally circulate between the economizer tubes 35 from the front end 13 to the rear end 15 of the boiler before exiting via the gas outlet 69. Heat transfer occurs between the flue gases and the water circulating in the economizer tubes 35 when flue gases are cooled down when flowing through economizer tubes 35 toward gas outlet 69 (see FIG. 3). The water circulating through the economizer tubes 35 then flows to the upper header 19 via usual feedwater connections.

Typically, water entering the economizer 3 of the boiler system 1 at temperatures of about 220° F. would, after going through the economizer 3, enter the furnace module 7 as feedwater at temperatures of about 280° F. This increase of temperature around 60° F. represents a significant amount of energy saved for heating up the fluid in the boiler. With environmental preoccupation oriented toward energy saving and better energy management, this potential energy saving represents a significant improvement. It typically allows for an increase of the efficiency of the unit from 81% to 85%.

Now referring to FIG. 2, in the present embodiment, the integrated economizer 3 comprises an upper header (also referred to as a boiler steam drum) 19 and two sub-assemblies 31 and 33 respectively located on each side of the upper header 19. The feedwater generally enters the economizer 3 at the rear end 15 of the boiler 1 and is fed to the two modules 31 and 33, which may comprise one or more circuits of the economizer tubes 35 in a parallel pattern longitudinal with the upper header 19 and arranged in a staggered pattern on the gas side for heat transfer optimization. Baffles 37 are typically used to force the flue gases to flow in zigzag in a cross flow pattern from the front end 13 to the rear end 15 to enhance the heat transfer process.

The number of baffles 37 comprised therein may vary from one configuration to the other.

Since the economizer module 3 is integrated with the boiler system 1, the tube arrangement of the economizer 3 provides for a direct connection of the feedwater outlet 73 to a boiler inlet, thereby ensuring a complete integration of the economizer 3 to the furnace module 5 of the boiler 1. This direct connection between the feedwater outlet 73 and the boiler inlet avoids the need for valves to isolate sub-assemblies 31 and 33 from the furnace 5 as is usually done in prior art boilers.

In the present embodiment, now referring to FIG. 3, the economizer module 3 is located on top of the furnace, with both sub-assemblies 31, 33 respectively encased in economizer casings 65 and 77. The economizer casing 65 may provide access to the inside tubing via cleaning doors 67 (see FIG. 4) to allow for cleaning of the tubing.

Still referring to FIG. 3, the economizer casing 160 is typically configured as a gas-tight chamber which is typically insulating material (e.g. mineral wool layers or the like known in the art). In addition, various sizes of economizer tubes 35 can be used to optimize the arrangement of the sub-assemblies 31, 33. Similarly, fins 79 of various configurations such as with varying thickness, height, number of fins per inch, segmented or solid fins or absence of fin can also be used for optimization of the system.

In the present embodiment, each of the economizer tubes 35 extend several times between the front end 13 and the rear end 15 of the boiler system 1, on each side of the upper header 19, in order for the boiler system 1 comprising the integrated economizer 3 to occupy the same floor space and the same height as a conventional boiler without integrated economizer.

Table 1 below provides data for one specific example of the boiler system according to the present invention:

| | |
|---|---|
| Temperature of the deaerator | 228° F. |
| Temperature of the steam in the boiler | 338° F. (at a pressure of 100 psi) |
| Temperature of the flue gases at the stack | 300° F. |

Higher temperatures can be reached by varying the pressure inside the boiler. For instance, with a pressure of 200 psi inside the furnace module, the temperature of furnace module is about 360° F.

Method for Producing High Temperature Fluid

As aforesaid, the invention is also directed to a method for producing high temperature fluid with a boiler system comprising an economizer module and a furnace module. The method comprises the steps of:

a) pre-heating a fluid, such as feedwater, by circulating the fluid through a pre-heating tube assembly of the economizer module, the economizer module being integrated on a top portion of the furnace module, the economizer module being in communication with the furnace module to receive heat and/or hot combustion gases produced by the furnace module; and b) further heating the fluid pre-heated in step a) by circulating the fluid through the furnace module having a combustion chamber producing said heat and hot combustion gases.

The boiler system for the application of the above disclosed method further comprises: a front wall, a rear wall and a pair of opposed side walls extending between the front and rear walls; an upper header extending between the front and rear walls along a mid-section of the top portion of the boiler system; a lower header extending between the front and rear walls along a mid-section of a bottom portion of the boiler system, and a plurality of tubes extending between the lower and upper headers while being in fluid communication therewith. Therefore, step a) of the method further comprises the step of: providing the fluid to be heated to an inlet connected to two tube sub-assemblies located respectively on each side of the upper header of the boiler system, each sub-assembly comprising a series of tubes fluidly connected to the inlet in which the fluid is pre-heated using the combustion gases from the furnace module.

According to one embodiment, in step a) of the method, the fluid may be circulated in each sub-assembly through one or more circuits of the tubes in a parallel pattern longitudinal with the upper header.

According to one embodiment, step a) of the method further comprises the step of optimizing heat transfer from the combustion gases to the fluid circulating in the tubes of the sub-assemblies by having the tubes of each sub-assembly arranged in a staggered pattern.

According to one embodiment, step a) of the method further comprises the step of enhancing heat transfer from the combustion gases to the fluid circulating in each sub-assembly of the economizer module by having a plurality of baffles alternatively extending from the upper header and from each respective side wall in order to force the combustion gases to flow in zigzag in a cross flow pattern from the front wall to the rear wall.

The invention is also directed to a method for producing high temperature fluid with the boiler system as disclosed herein. The method then comprises the steps of:

a) pre-heating a fluid by circulating the fluid through the pre-heating tube assembly of the economizer module; and b) further heating the fluid pre-heated in step a) by circulating the fluid through the furnace module.

The invention also concerns the use of the boiler system as defined herein for heating a fluid and producing high temperature fluid, in particular high-temperature steam It has been found that the present embodiment of the boiler system with its integrated economizer offers advantages with regard to nitrogen oxides ($NO_X$) emissions. As such, due to the presence of the economizer, the use of refractory material in the furnace module is reduced, thus reducing the formation of thermal $NO_X$ usually associated with the use of large furnace volume. As a result, the generation $NO_X$ may be held to a minimum when the combustion is under a steady load under ideal conditions with excess air maintained as low as possible.

Understandably, the present embodiment of boiler system with its integrated economizer generally mitigates several shortcomings of prior art boiler systems. For instance, due to the position of the economizer on top of the boiler, the combined boiler and economizer does not have a large footprint compared to a regular boiler system without an economizer. Hence, the present embodiment of the boiler system could be used in place of prior art boiler systems without needing addition floor space.

In addition, due to the complete integration of the economizer with the boiler system, the present embodiment of the boiler system can provide significant transportation and installation costs savings as boiler system and its economizer are transported and installed only once.

Furthermore, due to the total integration of the economizer with the boiler system, the boiler system generally has improved energy efficiency.

While illustrative and presently preferred embodiments of the invention have been described in detail hereinabove, it is to be understood that the inventive concepts may be otherwise variously embodied and employed and that the appended claims are intended to be construed to include such variations except insofar as limited by the prior art.

What is claimed is:

1. A boiler system comprising:

a furnace module that comprises:

a combustion chamber with a front wall, a rear wall, and a pair of opposed side walls;

a frame that extends vertically along the front and rear walls;

a top portion above the combustion chamber, wherein an upper header is disposed on the top portion that extends longitudinally from the front wall to the rear wall; and a plurality of heat exchange tubes that are in fluid communication with the upper header; the boiler system further comprising an economizer module that comprises:

a casing with two side portions that are mounted on the frame, wherein the header of the furnace module is disposed between the two side portions;

wherein each side portion has a top side that is disposed below an upper most portion of the header;

wherein each side portion defines a longitudinal passage that is parallel with the header;

wherein a flue gas inlet is disposed in a lower portion of the longitudinal passage of each side portion;

wherein a flue gas outlet is disposed in an upper portion of the longitudinal passage of each side portion;

wherein a plurality of baffles are disposed in each longitudinal passage in a staggered configuration from the respective inlet to the respective outlet;

wherein a tube sub-assembly for conveying fluid to be preheated is disposed within each longitudinal passage in a longitudinal direction from the respective flue gas inlet to the respective flue gas outlet;

wherein each tube sub-assembly is in fluid communication with the heat exchange tubes of the furnace module; and wherein the boiler system is configured such that flue gas generated in the furnace module exits the furnace module and enters the flue gas inlet of each economizer side portion, then travels through the longitudinal passage of each side portion in a serpentine fashion as a result of the baffles, and then exitseach side portion via the flue gas outlet of each side portion before entering a common flue gas outlet of the boiler system.

2. The boiler system of claim 1, wherein the economizer module further comprises a feedwater inlet configured to receive fluid and a feedwater outlet fluidly linking the economizer tube assembly to the upper header, wherein the feedwater inlet and the feedwater outlet are both located at a distal end of the upper header.

3. The boiler system of claim 1, wherein each tube sub-assembly comprises a series of economizer tubes fluidly connected to a feedwater inlet that is configured to receive fluid and a feedwater outlet that fluidly links the series of economizer tubes to the upper header.

4. The boiler system of claim 3, wherein each tube sub-assembly comprises one or more circuits of economizer tubes extending horizontally parallel to the upper header.

5. The boiler system of claim 4, wherein the economizer tubes of each tube sub-assembly are arranged in a staggered pattern for optimizing heat transfer from the flue gas to fluid circulating in the economizer tubes of the tube sub-assemblies.

6. The boiler system of claim 2, wherein the frame comprises:

a first upper horizontal conduit located proximate the front wall, a second upper horizontal conduit located proximate the rear wall and being in fluid communication with the upper header, a first lower horizontal conduit located proximate the front wall, a second lower horizontal conduit located proximate the rear wall and being in fluid communication with a lower header, a first pair of downcomers located adjacent the front wall and being in fluid communication with the first upper horizontal conduit and the first lower horizontal conduit, and a second pair of downcomers located adjacent the rear wall and being in fluid communication with the second upper horizontal conduit and the second lower horizontal conduit.

7. The boiler system of claim 6, wherein the downcomers add extra heating surfaces to recover heat from combustion gases.

8. The boiler system of claim 1, further comprising a lower header, a plurality of furnace tubes extending between and being in fluid communication with the upper header and the lower header, a horizontal floor section, a riser section extending vertically upwards and adjacent to one of the sidewalls, a plurality of interconnected U-shaped sections between one of the sidewalls and a central vertical plane of the boiler system, and an entry section extending between the U-shaped sections and the upper header.

9. The boiler system of claim 1, wherein the casing comprises at least one cleaning door providing access inside the economizer module to allow for cleaning and/or maintenance thereof.

10. The boiler system of claim 9, wherein the casing is configured as a gas-tight chamber, the casing being insulated with an insulating material.

11. The boiler system of claim 1, where the boiler system is a system for heating water.

12. A method for heating fluid with the boiler system as claimed in claim 1, the method comprising the steps of: a) pre-heating a fluid by circulating the fluid through each tube sub-assembly of the economizer module; and b) further heating the fluid pre-heated in step a) by circulating the fluid through the furnace module.

13. The method of claim 12, wherein step a) of the method further comprises a step of: providing the fluid to be preheated to an inlet connected to each tube sub-assembly, wherein each tube sub-assembly comprises a series of tubes fluidly connected to the inlet.

14. The method of claim 13, wherein in step a), the fluid is circulated in each tube sub-assembly through one or more circuits of tubes that are arranged horizontally and parallel with the upper header.

15. The method of claim 14, wherein step a) further comprises a step of optimizing heat transfer from combustion gases to fluid circulating in the tubes of each tube sub-assembly by arranging the tubes of each sub-assembly in a staggered pattern.

* * * * *